United States Patent [19]

Renardus et al.

[11] Patent Number: 4,546,284

[45] Date of Patent: Oct. 8, 1985

[54] LOW-PRESSURE MERCURY VAPOR DISCHARGE LAMP

[75] Inventors: Max L. P. Renardus; Bauke Sieswerda, both of Eindhoven, Netherlands

[73] Assignee: U.S. Philips Corporation, New York, N.Y.

[21] Appl. No.: 85,460

[22] Filed: Oct. 17, 1979

[30] Foreign Application Priority Data

Oct. 26, 1978 [NL] Netherlands ..... 7810672

[51] Int. Cl.[4] ..... H01J 1/02; H01J 7/24; H01J 61/52

[52] U.S. Cl. ..... 313/25; 313/17; 313/33; 313/44; 313/47

[58] Field of Search ..... 313/25, 33, 44, 47, 313/17, 493, 243, 239

[56] References Cited

U.S. PATENT DOCUMENTS

| | | | |
|---|---|---|---|
| 2,200,940 | 5/1940 | Uyterhoeven et al. | 313/44 |
| 3,209,188 | 9/1965 | Freeman | 313/47 X |
| 4,129,800 | 12/1978 | Benthem et al. | 313/25 |

*Primary Examiner*—Stanley T. Krawczewicz
*Attorney, Agent, or Firm*—Robert S. Smith

[57] ABSTRACT

A low-pressure mercury vapor discharge lamp having a lamp envelope (1) which encloses a folded tubular discharge vessel (2), the discharge vessel being provided with an appendix (6) which is kept at a relatively low temperature by a heat shield (7) located within the lamp envelope. The heat shield shields the outer wall surface of the appendix from the outer wall of the discharge vessel. The cooler appendix serves to maintain the mercury vapor pressure at an optimum value during operation of the lamp.

2 Claims, 1 Drawing Figure

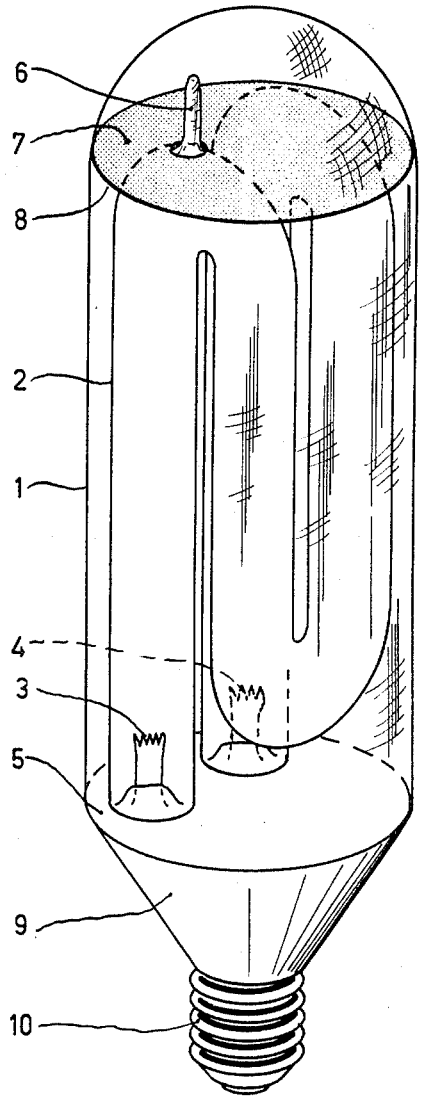
6
7
8
2
1
4
3
5
9
10

LOW-PRESSURE MERCURY VAPOR DISCHARGE LAMP

The invention relates to a low-pressure mercury vapor discharge lamp having a lamp envelope which encloses a folded tubular discharge vessel having a respective electrode at each end thereof. Such a lamp is disclosed in German Patent Specification 837,892.

By folding the discharge vessel a compact low-pressure mercury vapor discharge lamp can be obtained. If they have been provided with a suitable lamp base they may serve for use in luminaires for incandescent lamps for general illumination purposes. Generally, the tubular discharge vessel is enclosed by a lamp envelope so that not only in the shape of an incandescent lamp approached as closely as possible, but the lamp is also much easier to handle during use. No force is exerted on the discharge vessel itself when the lamp is fitted in a suitable luminaire.

As the discharge vessel is surrounded by an envelope, the temperature in the discharge vessel, owing to the poor ventilation during operation of the lamp, increases to such a value that the critical mercury vapor pressure (approximately 0.8 Pa) for an optimum conversion of electric power into ultraviolet radiation can easily be exceeded. As a consequence the efficiency of the lamp and the electric power consumed by the lamp decreases.

It is an object of the invention to provide a compact low-pressure mercury vapor discharge lamp in which the above-mentioned drawback is at least mitigated.

According to the invention a low-pressure mercury vapor discharge lamp of the type mentioned in the opening paragraph is characterized in that the discharge vessel is provided with a projecting appendix located within the lamp envelope, which appendix is kept at a relatively low temperature by a heat shield, located within the lamp envelope, which shields the outer wall surface of the appendix from the outer wall surface of the discharge vessel.

If the heat shield is in the form of a plate, a portion of the space between the discharge vessel and the lamp envelope can be protected by the plate from the heat radiated by the discharge in the discharge vessel. Consequently this space has a lower temperature than the remaining portion of the space between the discharge vessel and the lamp envelope. With the appendix of the discharge vessel located in the cooler space defined by the plate, the mercury vapor pressure during operation of the lamp remains near the above-mentioned value of 0.8 Pa in the entire discharge vessel. The temperature in the appendix remains at a relatively low value. Surprisingly it has been found that the influence of the heat radiated by the discharge which directly reaches the appendix is relatively low.

The appendix not only ensures a cool spot in the discharge vessel but can also be used to keep the plate in its place within the lamp envelope and support it.

The presence of the plate in the space between the lamp envelope and the discharge vessel has the advantage that, for the control of the mercury vapor pressure, no additional measures are required in the discharge vessel itself, such as the provision of cooling shields near the electrodes or the provision of a mercury amalgam. Neither is it necessary to have the appendix extend to outside the lamp envelope to maintain the required vapor pressure in the discharge vessel.

The heat shield may have various shapes and may consist of different materials. It may, for example, consist of a synthetic resin material plate whose side facing the discharge vessel is provided with a reflecting metal foil, for example aluminium. Alternatively the heat shield may consist of a material which is transmissive to visible light, but which reflects the infrared heat radiation. Favorable results were obtained with a glass plate whose side facing the discharge vessel was provided with a layer of indium oxide. Alternatively, the plate can be provided around the outer wall of the appendix.

An embodiment of the invention will now be described with reference to the accompanying drawing, the sole FIGURE of which shows schematically a low-pressure mercury vapor discharge lamp according to the invention.

The lamp comprises a glass lamp envelope 1. A folded U-shaped tubular discharge vessel 2 is located within the space defined by this envelope. Electrodes 3 and 4 are disposed at the respective ends of this discharge vessel. The discharge vessel is fitted to the base 5 of the lamp envelope.

A luminescent layer, consisting of a mixture of two phosphors, namely green luminescing terbium-activated cerium magnesium aluminate and red luminescing trivalent europium-activated yttrium oxide, is provided on the inner wall surface of the discharge vessel 2. The inner wall surface of the lamp envelope is provided with a light-dispersing layer of finel-distributed titanium dioxide. An appendix 6, which is kept at a relatively low temperature by a circular heat-shield 7 located within the lamp envelope, is provided near the bent portion of the U-shaped discharge vessel 2. This heat shield 7 consists of glass whose side facing the discharge vessel is provided with a layer 8 of indium oxide. This causes the infrared heat radiation generated in the discharge vessel to be reflected towards the discharge vessel but the visible light generated by the luminescent layer on the inner wall of the discharge vessel is transmitted. The increase of the temperature within the space enclosed by the inner wall surface of the appendix and produced by direct radiation of the discharge is low owing to the small dimensions of the appendix compared to the discharge vessel.

The end of the lamp envelope is provided with a lamp base 9 wherein a glow discharge starter and an inductive stabilization ballast are disposed, so that the lamp can be directly screwed into a conventional incandescent lamp luminaire by means of a suitable lamp cap 10.

In a practical embodiment of a lamp described above, the overall length of the U-shaped discharge vessel was approximately 44 cm; its inside diameter was approximately 9 mm. The appendix was approximately 30 mm long and had an inside diameter of approximately 4 mm. The circular glass plate 7 (located between the outer wall of the appendix and the outer wall of the discharge vessel) was approximately 5 mm thick and had a diameter of approximately 50 mm, which corresponded to approximately the inside diameter of the lamp envelope. The indium oxide layer was approximately 50 $\mu$m thick. When the above-mentioned phosphors were used the luminous flux of the lamp was 880 lumen at a power supplied to the lamp of 22 W. The discharge vessel contained approximately 20 mg of mercury as well as a small quantity of argon at a pressure of 400 Pa.

What is claimed is:

1. A low-pressure mercury vapor discharge lamp having a lamp envelope which encloses a folded tubular discharge vessel having a respective electrode at each end thereof, characterized in that the discharge vessel is provided with a projecting appendix located within the lamp envelope, which appendix is kept at a relatively low temperature by a heat shield, located within the lamp envelope, which cooperates with said projecting appendix to constrain relative movement therebetween, by being provided with an aperture which is demensioned for engagement with said projecting appendix, and which shields the outer wall surface of the appendix from the outer wall surface of the discharge vessel.

2. A low-pressure mercury vapor discharge lamp as claimed in claim 1, characterized in that the heat shield comprises a plate of light-transmissive material, the side of the plate facing the discharge vessel being provided with a layer of indium oxide.

* * * * *